United States Patent [19]

Murrin, Jr.

[11] Patent Number: 4,928,846

[45] Date of Patent: May 29, 1990

[54] PAINT CAN CONSTRUCTION

[76] Inventor: John A. Murrin, Jr., 30 Clark St. Extension, Randolph, Mass. 02368

[21] Appl. No.: 310,888

[22] Filed: Feb. 16, 1989

[51] Int. Cl.[5] ..... B65D 25/00

[52] U.S. Cl. ..... 220/354; 220/90

[58] Field of Search ..... 220/354, 90

[56] References Cited

U.S. PATENT DOCUMENTS

| | | | |
|---|---|---|---|
| 1,764,684 | 6/1930 | Jungerheld | 220/90 |
| 2,084,084 | 6/1937 | Greer | 220/354 |
| 2,207,210 | 7/1940 | Von Knauf | 220/354 |
| 2,321,492 | 6/1943 | Kinney | 220/90 |
| 2,709,022 | 5/1955 | Fatke | 220/354 |
| 2,885,108 | 5/1959 | Donoghue | 220/90 |
| 3,744,671 | 7/1973 | Saunders, Jr. | 220/90 |
| 3,945,527 | 3/1976 | Pylant | 220/90 |
| 4,279,358 | 7/1981 | Jacobs | 220/354 |
| 4,512,494 | 4/1985 | Von Holdt | 220/354 |
| 4,524,882 | 6/1985 | Buc | 220/354 |

*Primary Examiner*—Stephen Marcus
*Assistant Examiner*—Stephen Castellano
*Attorney, Agent, or Firm*—Leon Gilden

[57] ABSTRACT

A paint can construction is set forth wherein a paint can is provided with a conventional circumferential trough proximate the upper end of the paint can bounded by an exterior and interior flange. A series of equally spaced through-extending apertures are positioned through a floor of the trough to enable drainage and directing of paint contained within the trough interiorly of the can upon securement of the associated lid onto the can. An alternative form of the invention utilizes a series of biased downwardly extending plungers equal to the number of the apertures contained within the trough of the container whereupon the plungers are simultaneously actuated by a continuous ring overlying each of the plungers and secured to the plungers whereupon downwardly striking the plungers unclogs any of the apertures having contained paint therewithin to free the apertures for subsequent drainage.

7 Claims, 1 Drawing Sheet

PAINT CAN CONSTRUCTION

BACKGROUND OF THE INVENTION

1. Field of the Invention

The field of invention relates to paint cans, and more particularly pertains to a new and improved paint can construction wherein the same effects and expedites drainage of paint contained within the trough of the container.

2. Description of the Prior Art

The use of various paint can constructions to provide drainage interiorly of the can of paint trapped within the associated trough is known in the prior art. Prior art, however, has heretofore failed to provide drainage whereupon the apertures when cooperating with downwardly depending lugs fail to provide continuous drainage through the apertures as the lugs remain in situ. When utilized to clear the associated apertures, they thereby have limited the effective opening of such apertures to effect drainage. For example, U.S. Pat. No. 2,885,108 to Donoghue sets forth a typical example of a series of slotted apertures alignable with lugs formed on an associated lid to enable drainage of the can, however drainage is not available where the lid is in position due to the filling of the lugged opening within the container by the lugs of the lid and thereby limit drainage through the apertures and enable paint to be squeezed upwardly about the lid during securement of the lid to the container.

U.S. Pat. No. 2,207,210 to Von Knauf sets forth a series of apertures formed within one of the vertical walls defining the trough of the container wherein drainage is thereby limited to the spacing of the aperture above the floor of the trough and further limits pressurization and squeezing of the paint interiorly of the can from the trough upon securement of the lid to the trough.

U.S. Pat. No. 2,084,084 to Greer sets forth another example of slots formed within the trough of an associated paint can with lugs registrable in the slots to clear the slots for subsequent drainage, but the slots of the Greer patent are plugged by the lugs of the lid and thereby limits drainage of the trough upon securement of the lid to the container.

U.S. Pat. No. 2,709,022 to Fatke sets forth a series of apertures within a trough with pins formed within the lid that may be struck to dislodge plugs underlying the pins within the trough to enable opening of apertures available upon removal of the plugs The pins of the Fatke patent remain in position within the aperture and further are not normally retractable for subsequent clearing of the apertures.

U.S. Pat. No. 4,279,358 to Jacobs sets forth a further example of a trough within a paint can formed with apertures With a resilient closure securable overlying the trough.

As such, it may be appreciated that there is a continuing need for a new and improved paint can construction wherein the same addresses both the problems of ease of use and effectiveness of operation, and in this respect, the present invention substantially fulfills this need.

SUMMARY OF THE INVENTION

In view of the foregoing disadvantages inherent in the known types of paint cans now present in the prior art, the present invention provides a paint can construction wherein the same effectively enables drainage into the interior confines of the paint can of paint trapped between an associated lid and a registering trough. As such, the general purpose of the present invention, which will be described subsequently in greater detail, is to provide a new and improved paint can construction which has all the advantages of the prior art paint can devices and none of the disadvantages.

To attain this, the present invention comprises a paint can formed with a series of through-extending apertures formed through the floor of an associated trough of a paint can with a cooperating lid provided with a downwardly extending trough received within the trough of the paint can wherein the trough of the lid may optionally contain resiliently retracted plungers to periodically drive the plungers cooperating with a unitary circumferential overlying ring to clear the underlying apertures of the paint can and trough.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint can construction which has all the advantages of the prior art paint cans and none of the disadvantages.

It is another object of the present invention to provide a new and improved paint can construction which may be easily and efficiently manufactured and marketed.

It is a further object of the present invention to provide a new and improved paint can construction which is of a durable and reliable construction.

An even further object of the present invention is to provide a new and improved paint can construction which is susceptible of a low cost of manufacture with regard to both materials and labor, and which accordingly is then susceptible of low prices of sale to the consuming public, thereby making such paint can construction economically available to the buying public.

Still yet another object of the present invention is to provide a new and improved paint can construction which provides in the apparatuses and methods of the prior art some of the advantages thereof, while simultaneously overcoming some of the disadvantages normally associated therewith.

Still another object of the present invention is to provide a new and improved paint can construction with a series of apertures formed through a floor of the paint can trough to enable periodic clearing of paint contained within the apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawing wherein.

DESCRIPTION OF THE PREFERRED EMBODIMENT

Figure 1:
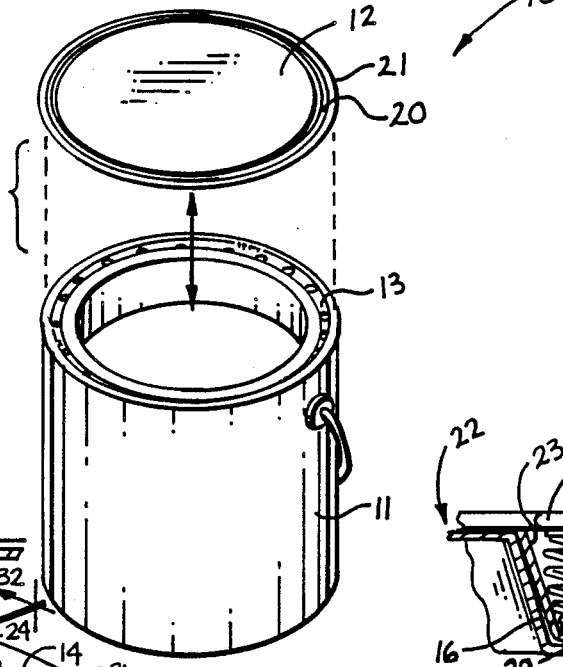
FIG. 1 is an isometric illustration of the instant invention.

With reference now to the drawings, and in particular to FIGS. 1 to 5 thereof, a new and improved paint can construction embodying the principles and concepts of the present invention and generally designated by the reference numeral 10 will be described.

Figure 2:
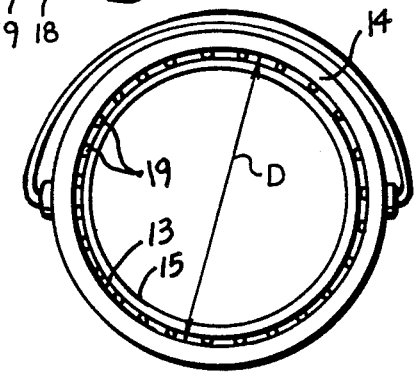
FIG. 2 is an orthographic top view of the paint can of the instant invention.
Figure 3:
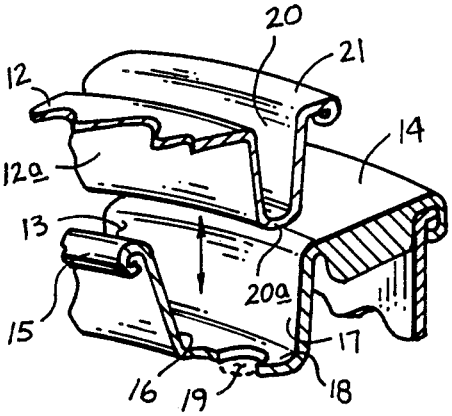
FIG. 3 is an isometric illustration, somewhat expanded, of the paint can trough and associated lid trough.

More specifically, it will be noted that the paint can construction 10 essentially comprises a container 11 formed with a cooperating lid 12 and a perimeter flange 21 to overlie an outer flange ring 14 of the container 11. The lid 12 includes an annular downwardly extending rib 12*a* defining a lid trough 20, including a floor 20*a* to be received within a complimentarily configured container trough 13 of a first diameter "D" defined by the upper circumferential end of exterior slated wall 17, as illustrated in FIG. 2. The container trough 13 is defined by the outer flange ring 14 and an interior flange ring 15 with a downwardly extending interior slanted wall 16, the exterior slanted wall 17, and a horizontally oriented floor 18 formed between the interior and exterior walls 16 and 17. A series of through-extending apertures 19 are formed through the floor 18 to enable drainage of paint trapped within the trough 13 to drain interiorly of the container 11. Further, as the annular rib 12*a* is forced into the receiving complimentarily configured container trough 13, the remaining fluid within the trough 13 is forced under pressure interiorly of the paint can as the rib 12*a* is received within the container trough 13. Further, it may be appreciated that the depth of the container trough 13 is substantially equal to that of the height of the annular rib 12*a* to substantially eliminate remaining volume within the container trough 13 as the annular rib 12*a* is received therewithin and thereby effectively eliminating fluid remaining within the trough 13.

Figure 4:
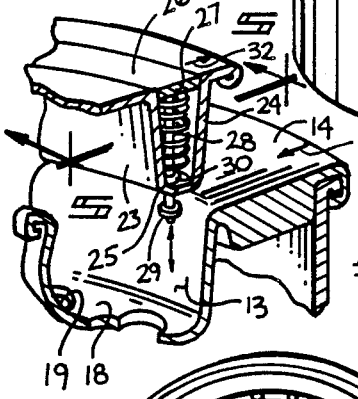
FIG. 4 is an isometric illustration of a modification of the instant invention.
Figure 5:
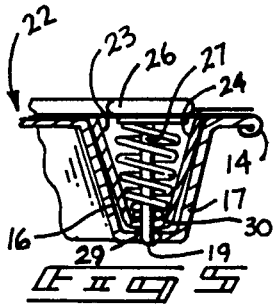
FIG. 5 is an orthographic view taken along the lines 5—5 of FIG. 4 in the direction indicated by the arrows.

Attention is directed to FIGS. 4 and 5 wherein a modification of the instant invention utilizes a modified container lid 22. The container lid 22 is formed with a interior slanted lid wall 23, and exterior slanted lid wall 24 to define a lid trough 25 therewithin with an annular ring 26 substantially overlying the lid trough 25. The ring 26 includes a series of downwardly extending rods 27 orthogonally and fixedly secured to the ring 26 of a spacing equal to that of the spacing of the associated apertures 19. The lid trough 25 is of a depth less than that of the depth of the associated container trough 13 but is also of a complementary configuration in that the slanted walls 23 and 24 are securedly received within the trough 13 with only the floor of the trough 25 extending above the floor 18 of the container trough.

A spring member 28 is captured between the floor of the lid trough 25 and the annular ring 26 to normally bias the ring 26 upwardly. The series of rods 27 extend downwardly through the floor of the trough 25 and are maintained at a fixed position relative to the floor of the trough 25 by an orthogonally oriented abutment ring 29 formed below the floor of the trough 25 with the rods 27 slidingly reciprocatable through seals 30 formed through the openings in the floor of trough 25 to sealingly position the rods 27.

Proper orientation of he modified lid 22 relative to the container 11 is effected by a can indicator indicia 31 formed on the outer flange ring 14 of the container 11 with a registering lid indicia 32 formed on the outer flange of the lid 22 to enable proper orientation of the lid 22 relative to the can 11 to orient the rods 27 relative to the associated apertures 19.

Accordingly, periodic clearing of paint and the like that may be dried and restricting the various apertures 19 may be cleared by the periodic striking of the continuous ring 26 and accordingly driving the rods 27 downwardly through the apertures 19 to thereby clear the associated apertures 19.

As to the manner of usage and operation of the instant invention, the same should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials. shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A paint can construction comprising:

a container formed with an annular trough formed about an opening of the container wherein the trough is defined by an interior outwardly slanting wall spaced radially inwardly of an exterior inwardly slanting wall, each wall including an upper end and a lower end wherein the walls are joined together at their lower ends by a trough floor, the trough floor including a series of through-extending apertures therethrough, the trough is further defined by a first diameter defined by the upper end of the exterior wall formed symmetrically about the opening of the container, and a lid formed with a downwardly extending rib defining a lid trough therewithin wherein said rib includes an interior lid wall and exterior lid wall with a connecting lid floor of complementary configuration to said annular trough and defined by a diameter equal to said first diameter, and wherein the lid trough includes a series of downwardly extending rods extending through the lid floor, and wherein said downwardly extending rods are commonly joined at upper terminal ends thereof by an annular ring orthogonally and fixedly secured to said rods and overlying said lid trough.

2. A paint can construction as set forth in claim 1 wherein the rods extend through encircling seals formed through the lid floor.

3. A paint can construction as set forth in claim 2 wherein a spring means is captured between the lid floor and the annular ring to normally bias the annular ring upwardly of the lid floor.

4. A paint can construction as set forth in claim 3 wherein the rods each include an abutment ring fixedly secured and orthogonally to each of said rods below the lid floor and above lower terminal ends of each rod to limit upward reciprocation of said rods relative to said lid floor.

5. A paint can construction as set forth in claim 4 wherein said downwardly extending rib of said lid is of a depth less than the annular trough of said container to normally position the lid floor spaced above the trough floor when the extending rib is received within the annular trough.

6. A paint can construction as set forth in claim 5 wherein a first indicator indicia is formed on said container alignable with a second indicator indicia formed on said lid to align and position said rods relative to said apertures.

7. A paint can construction as set forth in claim 6 wherein the lower terminal ends of said rods are normally positioned above the trough floor in a first position when the downwardly extending rib of the lid is received within the annular trough and reciprocatable downwardly to a second position wherein the lower terminal ends of said rods extend through said apertures when the annular ring is forced downwardly relative to the lid floor.

* * * * *